US009067436B2

(12) United States Patent
Ramesh et al.

(10) Patent No.: US 9,067,436 B2
(45) Date of Patent: Jun. 30, 2015

(54) METHOD AND APPARATUS FOR DETERMINING A DEGREE OF CURE IN AN ULTRAVIOLET PRINTING SYSTEM

(75) Inventors: Palghat Srinivas Ramesh, Pittsford, NY (US); Michael D. Thompson, Rochester, NY (US); David A. Vankouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 207 days.

(21) Appl. No.: 13/537,104

(22) Filed: Jun. 29, 2012

(65) Prior Publication Data

US 2014/0002558 A1 Jan. 2, 2014

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41M 7/0072; C09D 11/38
See application file for complete search history.

(56) References Cited

U.S. PATENT DOCUMENTS

| | | | | |
|---|---|---|---|---|
| 7,213,915 | B2 * | 5/2007 | Tsutsumi et al. | 347/102 |
| 7,708,368 | B2 * | 5/2010 | Kachi | 347/19 |
| 8,079,697 | B2 * | 12/2011 | Niekawa | 347/102 |
| 2005/0190248 | A1 * | 9/2005 | Konno et al. | 347/102 |
| 2010/0007692 | A1 * | 1/2010 | Vanmaele et al. | 347/21 |
| 2012/0268586 | A1 * | 10/2012 | Yousef et al. | 348/88 |

* cited by examiner

*Primary Examiner* — Manish S Shah
*Assistant Examiner* — Jeremy Delozier
(74) *Attorney, Agent, or Firm* — Ronald E. Prass, Jr.; Prass LLP

(57) ABSTRACT

An approach is provided for determining a degree of curing of one or more ultraviolet sensitive inks. The approach involves causing, causing, at least in part, one or more ultraviolet inks to be applied to a substrate to form an image. The approach also involves causing, at least in part, the image to be exposed to ultraviolet light produced by one or more ultraviolet light sources to cause, at least in part, the one or more ultraviolet inks to be cured to form a cured image. The approach additionally involves determining a reflectance value of the cured image. The approach further involves determining a degree of cure of the cured image based, at least in part, on the reflectance value. The approach may be used to alter the degree of curing of another image applied to a substrate.

20 Claims, 6 Drawing Sheets

METHOD AND APPARATUS FOR DETERMINING A DEGREE OF CURE IN AN ULTRAVIOLET PRINTING SYSTEM

FIELD OF DISCLOSURE

The disclosure relates to an apparatus and method for determining a degree of cure of one or more ultraviolet (UV) sensitive inks having been cured as part of a printing process.

BACKGROUND

UV curable inks are widely used in the printing industry for a variety of applications from varnishing, packaging, food and pharmaceutical labeling, etc. These inks cure and harden when exposed to UV radiation resulting in durable images which exhibit very good adhesion on a variety of substrates. Conventional methods for determining how well, or how much, the UV ink has been cured are done offline where the durability or adhesion of the image may be tested using a methyl ethyl ketone (MEK) rub test or similar procedure. This can be extremely wasteful in both time and materials.

SUMMARY

Therefore, there is a need for an approach to determine a degree of cure of one or more ultraviolet sensitive inks having been cured as part of a printing process.

According to one embodiment, a method comprises causing, at least in part, one or more ultraviolet inks to be applied to a substrate to form an image. The method also comprises causing, at least in part, the image to be exposed to ultraviolet light produced by one or more ultraviolet light sources to cause, at least in part, the one or more ultraviolet inks to be cured to form a cured image. The method further comprises determining a reflectance value associated with the cured image. The method additionally comprises determining a degree of cure of the cured image based, at least in part, on the reflectance value.

According to another embodiment, an apparatus comprises at least one processor, and at least one memory including computer program code for one or more computer programs, the at least one memory and the computer program code configured to, with the at least one processor, cause, at least in part, the apparatus to cause, at least in part, one or more ultraviolet inks to be applied to a substrate to form an image. The apparatus is also caused to cause, at least in part, the image to be exposed to ultraviolet light produced by one or more ultraviolet light sources to cause, at least in part, the one or more ultraviolet inks to be cured to form a cured image. The apparatus is further caused to determine a reflectance value associated with the cured image. The apparatus is additionally caused to determine a degree of cure of the cured image based, at least in part, on the reflectance value.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method and apparatus for determining a degree of cure of one or more ultraviolet sensitive inks having been cured as part of a printing process are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "curing process attribute" refers to one or more of a wavelength of light produced by an ultraviolet light source, an intensity of the ultraviolet light source, an exposure time that one or more ultraviolet inks are exposed to light produced by the ultraviolet light source, a media type, a media coating, etc.

As used herein, the term "degree of cure" refers to how much a UV ink image is caused to be cured by a UV light or radiation source.

As used herein, the term "reflectance," or any variation thereof refers to an amount of light that is reflected by a measured image and/or an amount of light that is allowed to pass through the measured image and a substrate upon which the measure image is applied. Light that is reflected or allowed to pass through the measured image and the substrate may be sensed by sensor.

As used herein, the term "absorptivity" refers to an amount of UV radiation absorbed by a UV ink image, for example.

As used herein, the term "intensity" refers to a strength or power level of a UV light source, for example.

Figure 1:
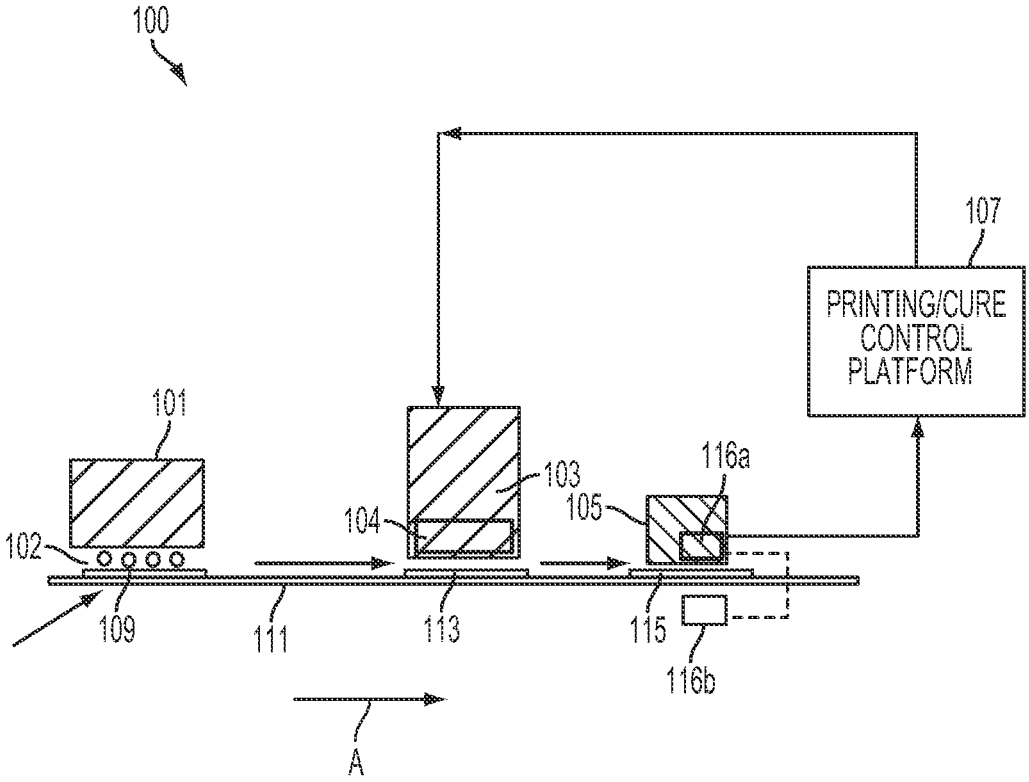
FIG. 1 is a diagram of a system capable of determining a degree of cure of one or more ultraviolet sensitive inks having been cured as part of a printing process, according to one embodiment.

FIG. 1 is a diagram of a system capable of determining a degree of cure of one or more ultraviolet sensitive inks having been cured as part of a printing process, according to one embodiment. UV curable inks are widely used in the printing industry for a variety of applications from varnishing, packaging, food and pharmaceutical labeling, etc. These inks cure and harden when exposed to UV radiation resulting in durable images which exhibit very good adhesion on a variety of substrates. Conventional methods for determining how well, or how much, an ink has cured are typically done offline where the durability or adhesion of the image may be tested using an MEK rub test or similar procedures. This type of testing for and determination of degree of ink cure can be an extremely wasteful exercise in both time and materials, and can cause delays in a print job being completed.

To address this problem, a printing system 100 of FIG. 1 introduces the capability to determine a degree of cure of one or more ultraviolet sensitive inks having been cured as part of a printing process. Because conventional methods for determining how well an image has been cured are done offline, there are no inline systems for determining and/or quantifying how much an image has been cured. Information regarding how well a printing system, such as printing system 100, cures a UV ink may be used to improve, or modify, the degree of cure of UV ink applied to a substrate during a print run, for example, on demand and in real time. It should be noted that in one or more embodiments, a system of networked printing systems 100 may include two or more printing systems 100, and each of the printing systems 100 may be configured to output a respective copy of an image. Accordingly, in some embodiments, the two or more printing systems 100 may be individually calibrated to a single reflectance spectra or to attain a target degree of cure that is uniform among all printing systems 100 across the system of two or more printing systems in the manner discussed below in view of a single printing system 100 for clarity.

In one or more embodiments, the printing system 100 may be configured to determine the degree of cure of one or more UV inks that form an image and cause a subsequent image to cure a same amount as the first image or to cure a different amount that is greater than or less than the amount that the first image is determined to have been cured. For example, if the first image was cured 100%, the printing system 100 may be configured to change the degree of cure so as to only partially cure the subsequent image by adjusting any of various determinable curing attributes associated with the determined degree of cure of the first (or any previous) image. Such a change in degree of cure, for example, from a 100% cure to a lesser degree may be used to stabilize an image before the image is subjected to further processing such as leveling. In such cases, controlling the degree of cure at some intermediate level between printing and leveling is helpful to, for example, aid in avoiding various image quality defects such as pin-holes or corduroy defects that are an inherent byproduct of inkjet printing.

Such defects and are typically mitigated by leveling an image by way of a leveling device and/or causing reflow of the image. But, these mitigation techniques often cause additional defects such as image offset to the leveling device and/or additional or first-time-occurrence pin-hole defects in the image. Partially curing the image, as discussed above, aids in limiting any image offset that may occur to a leveling device, as well limiting any pin-holes defects that may form during a reflow step. For example, some or all of the image may be partially cured to a certain degree so that the image does not offset as much, if at all, during leveling, and/or the image does not overly flow during a reflow step resulting in pin-hole defects. Or, for example, if selected portions of the image are partially cured and the image is caused to reflow, the selected partially cured portions may reflow less than uncured portions, facilitating a leveling of the image while reducing or eliminating significant occurrences of pin-hole defects.

As shown in FIG. 1, the printing system 100 comprises a printing station 101, a UV curing station 103, a UV reflectance device 105, and a printing/cure control platform 107.

According to various embodiments, the printing system 100 causes the printing station 101, which may comprise, for example, one or more inkjets, to apply one or more UV inks 102 to a substrate 111 to form an uncured image 109. The UV ink 102, for example, may be any ultraviolet sensitive ink such as a liquid or gel ink. In one or more embodiments, the substrate 111 may be processed by the printing system 100 in either webbed or sheeted form.

The substrate 111 is advanced through the printing system 100 in a process direction A to a UV curing station 103 to cure, or partially cure, the uncured image 109 to form a cured image 113. According to various embodiments, the printing system 100 advances the substrate 111 through the printing system 100 at a controllable process speed such as a set number of sheets per minute, or a particular speed in m/s, ft/s, etc. According to various embodiments, the process speed is in a direct relationship with an exposure or curing time during which the uncured image 109 is exposed to UV radiation produced by the UV curing station 103. Alternatively, the printing system 100 may be configured to momentarily pause the movement of the substrate 111 through the printing system 100 such that the exposure time is based on that momentary pause, which may be configurable, rather than the process speed. In some embodiments, the process speed may be fixed, however.

The UV curing station 103 may, in some embodiments, comprise any number of UV light sources 104, for example. The UV curing station 103, in some embodiments, may be configurable to selectively vary a wavelength of UV light produced by the UV curing station 103 and/or an intensity of the UV light produced by the UV curing station 103. For example, the intensity may be varied on demand by changing a number of UV light sources 104 that are used to radiate UV light onto the substrate 111, and/or by increasing or decreasing a power level of the UV light sources 104. If, for example, the UV curing station 103 is configurable to vary the wavelength of UV light produced, the UV curing station 103 may comprise UV light sources 104 that may themselves be able to vary a wavelength the UV light sources 104 produce, or the UV curing station 103 may comprise any number of selectively actuated UV light sources 104 that each produce a different wavelength of light, for example.

Accordingly, as the substrate 111 is advanced to and processed by the UV curing station 103, the uncured image 109 becomes the cured image 113. The printing system 100 then advances the substrate 111 having the cured image 113 to the UV reflectance device 105 where reflectance data associated with the cured image 113 is collected. In one or more embodiments, the cured image 113 may be referred to as the measured image 115 meaning that reflectance data associated with the cured image 113 has been or is being collected.

The UV reflectance device 105 may be any of a photometer, spectrometer, photospectrometer, etc. that comprises, for example, any number of sensors 116*a*, 116*b* positioned above or below an image side of the substrate 111. In one or more embodiments, the UV reflectance device 105 collects data regarding UV absorption spectra of UV light in, for example, the near UV wavelength band (320-420 nm) to which the measured image 115 is exposed. The UV absorption spectra data may be collected based, for example, on an amount of light that is reflected by the measured image 115 and/or an amount of light that is allowed to pass through the measured image 115 and the substrate 111. Light that is reflected may be sensed by sensor 116*a*, for example, while light that passes through the measured image 115 and the substrate 111 may be sensed by sensor 116*b*.

Data collected by the UV reflectance device 105 is communicated to the printing/cure control platform 107 for processing. The printing/cure control platform 107 is configured to correlate the reflectance data collected by the UV reflectance device 105 to a degree of cure to which the measured image 115 has been cured on any of a variety of substrates 111. The printing/cure control platform 107, according to various embodiments, is also configured to control the degree of cure of any subsequent image formed on substrate 111 by the printing station 101, for example, by causing the UV curing station 103 to vary any determinable curing attributes such as wavelength of UV light, an intensity of light produced by the UV curing station 103, and/or causing the printing system 100 as a whole to vary the exposure time to which the uncured image 109 is exposed to the UV light produced by UV curing station 103 to form the cured image 113.

For example, curing a UV ink involves photo-polymerization which is triggered when UV energy is absorbed by photoinitiators. UV inks often comprise these photoinitiators, among oligomers, pigments, and other components to stabilize the ink and for controlling viscosity. For any UV ink, the degree of cure depends on various curing attributes such as the UV light source spectra (i.e. wavelength), intensity, thickness of the ink layer, and substrate type and/or coating, for example.

In one or more embodiments, the printing/cure control platform 107 may be preloaded with absorptivity spectra data associated with various combinations of uncured UV inks and media types and/or coatings. Then, based on the data provided by the UV reflectance device 105, the printing/cure control platform 107 may determine a shift in absorptivity spectra in the near UV band between the uncured UV ink/media combination and reflectance data associated with the measured image 115. Thus by comparing the determined cured image spectrum data to reference spectra over a range of cure states, the cure state of the sample can be ascertained. The printing/cure control platform 107 may also be configured to determine any number of curing attributes associated with the measured image 115 from which the reflectance data is based, and cause any selected degree of cure of a subsequent image formed by the printing station 101 by changing or maintaining any combination of the determined print attributes based on the following.

It can be shown that the absorptivity spectra at any cure state can be expressed as a linear combination of the spectra for the uncured and cured states:

$$K(\lambda)=(1-r)K_{uc}(\lambda)+rK_c(\lambda)(\lambda) \quad (1)$$

In this example equation, Kuc is the absorptivity spectra for the uncured state and Kc is the absorptivity spectra for the cured state in the near UV band (where wavelength λ is 320-420 nm). The parameter r is the degree of cure, referred to above. The degree of cure r is determinable by linear regression for various cure states. For example, the degree of cure parameter (r) may be expressed as a function of the cure time (t) for fixed curing power by the equation:

$$r=(1-\exp(-(t/\tau)^n) \quad (2)$$

For an alternate embodiment, the degree of cure may be expressed in terms of the curing power (P) for fixed cure time (time for which the image is exposed to the UV)

$$r=(1-\exp(-(P/P_0)^m) \quad (2a)$$

In some embodiments, τ is 2.86 s and n is 0.65 in Equation 2, but these values may be varied on demand for any ink/media combination scenario.

The equation for r may be used to determine the exposure time needed to achieve a certain level of partial cure (for e.g. 2 s for 50% cure). But, for some inline sensing applications, the process speed (and thus the exposure time) or any momentary pause for curing may be fixed. Accordingly, if the exposure time is fixed and cannot be adjusted, the printing/cure control platform 107 may adjust the intensity of the UV light produced by the UV curing station 103 to vary the degree of cure of a subsequent image. As discussed above, the degree of cure is a function of at least the intensity and exposure time. The curing attributes discussed above cause a particular total number of photons to which an image is exposed when the UV curing station 103 causes the cured image 113. Varying any of the curing attributes may result in a change in the amount of photon exposure, which in turn, results in a change in the degree of cure.

Using the Kubelka-Munk theory, the reflectance spectra for clear and pigmented UV inks for a variety of substrate reflectances may be estimated. The reflectance value from this theory is given by $$R=\frac{1-R_s(a-b\coth(bSL)}{a-R_s+b\coth(bSL)} \quad (3)$$

In this example, Rs is the substrate reflectance, a=(1+K/S), $b=\sqrt{a^2-1}$, and L is the thickness of the ink layer. K and S are the absorption and scattering spectra, respectively. Based on the measurement data provided by the UV reflectance device 105, K can be related to the degree of cure using Eq. (1), discussed above. Experimental data suggests that S is relatively insensitive to the degree of cure. So, for a given UV ink, the measured reflectance in the near UV band is mostly a function of the degree of cure (r), substrate reflectance (Rs), and ink thickness (L). This functional dependence can be used to determine the degree of cure of the measured image 115 and control the degree of cure any subsequent uncured image 109.

Accordingly, in one or more embodiments, the printing/cure control platform 107 processes the data collected by the UV reflectance device 105 in view of the above equations to correlate the reflectance data to determined the degree of cure of the measured image 115 at the UV reflectance device 105. The printing/cure control platform 107 may, as discussed above, adjust any of the curing attributes in view of the determined degree of cure to achieve a desired target degree of cure. The target degree of cure may be any value between 0% and 100% cure, for example, of a subsequent image formed by the application of the one or more UV inks 102 on the substrate 111.

In one or more embodiments, the desired target degree of cure can be established during set-up on specific image pile heights and substrate (if, for example, a benchmark degree of cure is previously established for the print system 100), or during run time of a print job where the cure state is unknown and can optionally be continuously monitored and adjusted.

In one or more embodiments, the substrate 111 may have multiple uncured images 109 formed on at least one surface of the substrate 111 that are all caused to become cured images 113. The degree of cure of the multiple cured images 113 may be determined based on at least a measurement of one of the cured images 113 being a measured image 115. The designated measured image 115 may be, for example, a test swatch having a known L value (i.e. ink layer thickness) positioned on the substrate 111. The printing/cure control platform 107 may make an assumption that any other cured image 113 formed on the substrate 111 is caused to be cured to the same degree as the test swatch. In this embodiment, the determined degree of cure of any other cured image 113 that is other than the test swatch is essentially an estimated degree of cure because the other cured image 113 is not itself measured for reflectance data, but rather the test swatch is.

Figure 2:
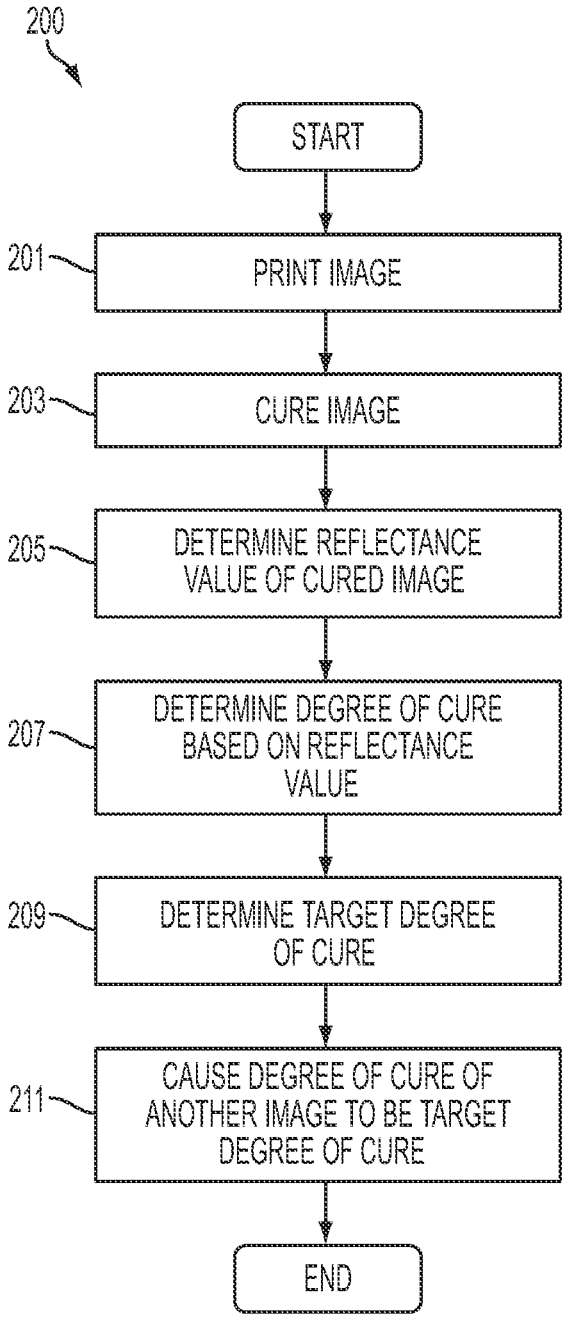
FIG. 2 is a flowchart of a process for determining a degree of cure of one or more ultraviolet sensitive inks having been cured as part of a printing process, according to one embodiment.
Figure 6:
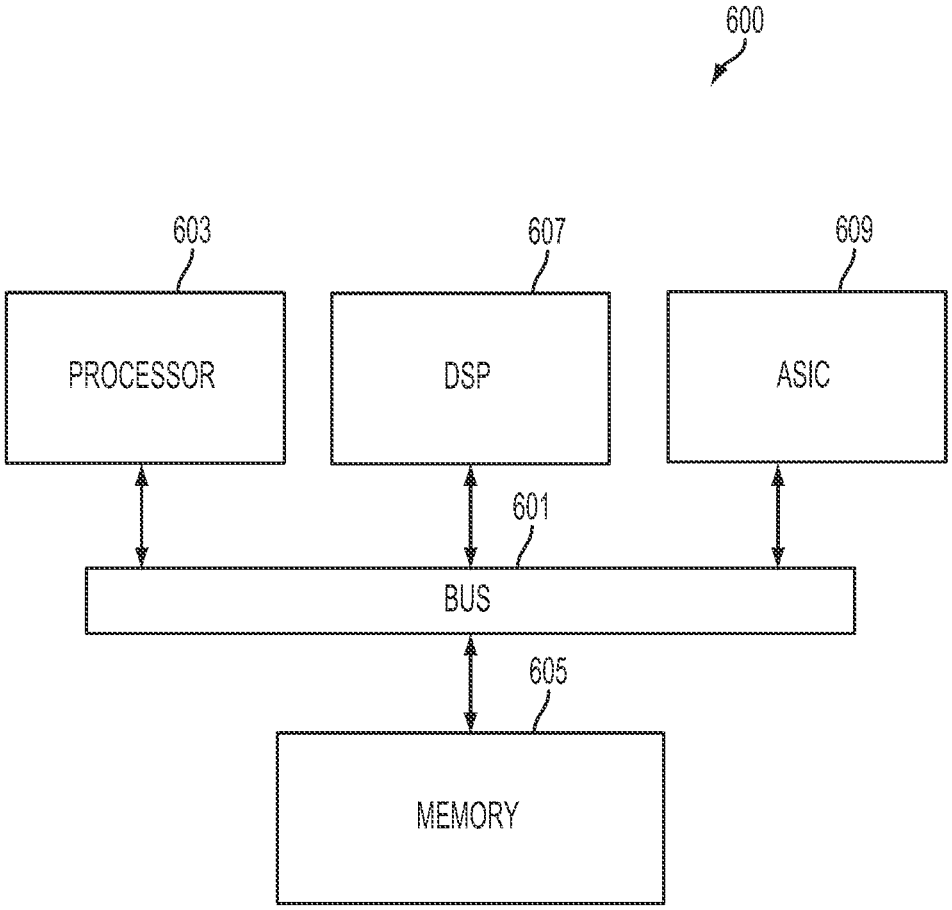
FIG. 6 is a diagram of a chip set that can be used to implement an embodiment.

FIG. 2 is a flowchart of a process for determining a degree of cure of one or more ultraviolet sensitive inks having been cured as part of a printing process, according to one embodiment. In one embodiment, the printing/cure control platform 107 performs the process 300 and is implemented in, for instance, a chip set including a processor and a memory as shown in FIG. 6. In step 201, the printing/cure platform 107 causes, at least in part, one or more of the ultraviolet inks 102 to be applied to a substrate 111 to form an uncured image 109, as discussed above. Then, in step 203, the printing/cure control platform 107 causes, at least in part, the uncured image 109 to be exposed to ultraviolet light produced by one or more ultraviolet light sources 104 to cause, at least in part, the one or more ultraviolet inks 102 to be cured to form a cured image 113. Next, in step 205, the printing/cure control platform 107 determines a reflectance value of the cured image 113 (i.e. by advancing the cured image 113 to the UV reflectance device 105, as discussed above and determining an absorption spectra value, the cured image 113 thereby becomes the measured image 115). Then, in step 207, the printing/cure control platform 107 determines a degree of cure of the cured image 113 based, at least in part, on the reflectance value ascertained based on data provided by the UV reflectance device 105 when the cured image 113 becomes the measured image 115.

As discussed above, the reflectance value may be determined based, at least in part, on determined absorptivity spectra value for the one or more ultraviolet inks at a time before curing and determined absorptivity spectra value of the measured image 115. As such, in one or more embodiments, the reflectance value may be determined based on an absorptivity spectral shift that is based on a comparison of the absorptivity value of the one or more ultraviolet inks 102 before curing and the absorptivity spectra value of the measured image 115.

The process optionally continues to step 209 in which the printing/cure control platform 107 determines a target degree of cure that may be the same or different from the determined degree of cure. For example, the target degree of cure may be any value between 0 and 100% cured, or any percentage of the determined degree of cure in various embodiments. Then, in step 211, the printing/cure control platform 107 causes, at least in part, a degree of cure of another cured image 113 to be the target degree of cure by varying or maintaining any of one or more curing process attributes that are associated with the determined degree of cure. The various curing process attributes may, in various embodiments, include an intensity of the one or more ultraviolet light sources 104, an exposure time of the uncured image 109 to the ultraviolet light, a wavelength of the ultraviolet light produced by the one or more ultraviolet light sources 104, or any combination thereof.

Figure 3:
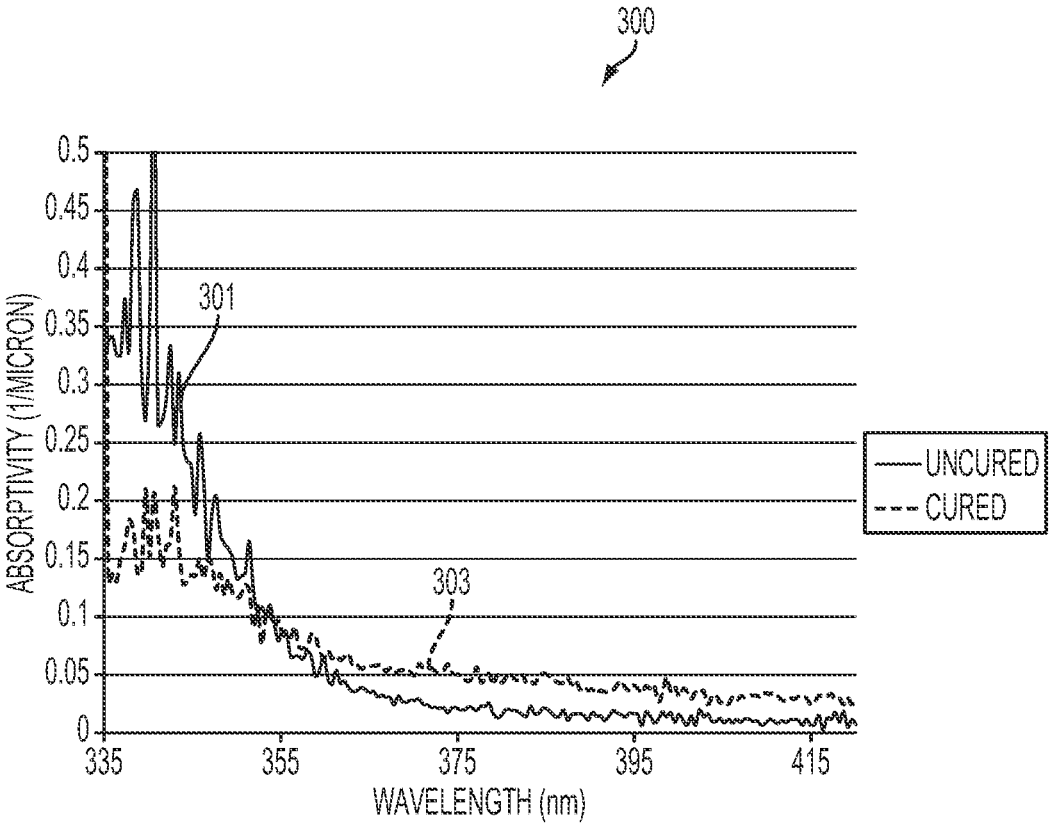
FIG. 3 is a chart illustrating an example spectral shift between a cured and an uncured ultraviolet ink, according to one embodiment.

FIG. 3 is a chart 300 illustrating a determinable absorptivity spectral shift for an example measured image 115, discussed above, in which the measured image 115 is a 6 micron thick sample of clear ink in uncured and cured states. In this example, the printing system 100, for instance, either had absorptivity data for an uncured image 109, or measured the uncured image 109 by way of the UV reflectance device 105, discussed above. The graph 300 illustrates the absorptivity spectra for wavelengths in the near UV wavelength band. For example, the uncured line 301 illustrates the absorptivity spectra of the uncured image 109. The cured line 303 illustrates the absorptivity spectra of the cured image 113 when it is the measured image 115 as measured by the UV reflectance device 105. In this example, the cured image 113 is 100% cured.

As discussed above, a noticeable spectral shift occurs between the uncured line 301 and the cured line 303 at various wavelengths. This spectral shift occurs for any type of ink, color ink, ink thickness, media type, etc., and may be used to determine the degree of cure, as discussed above.

Figure 4:
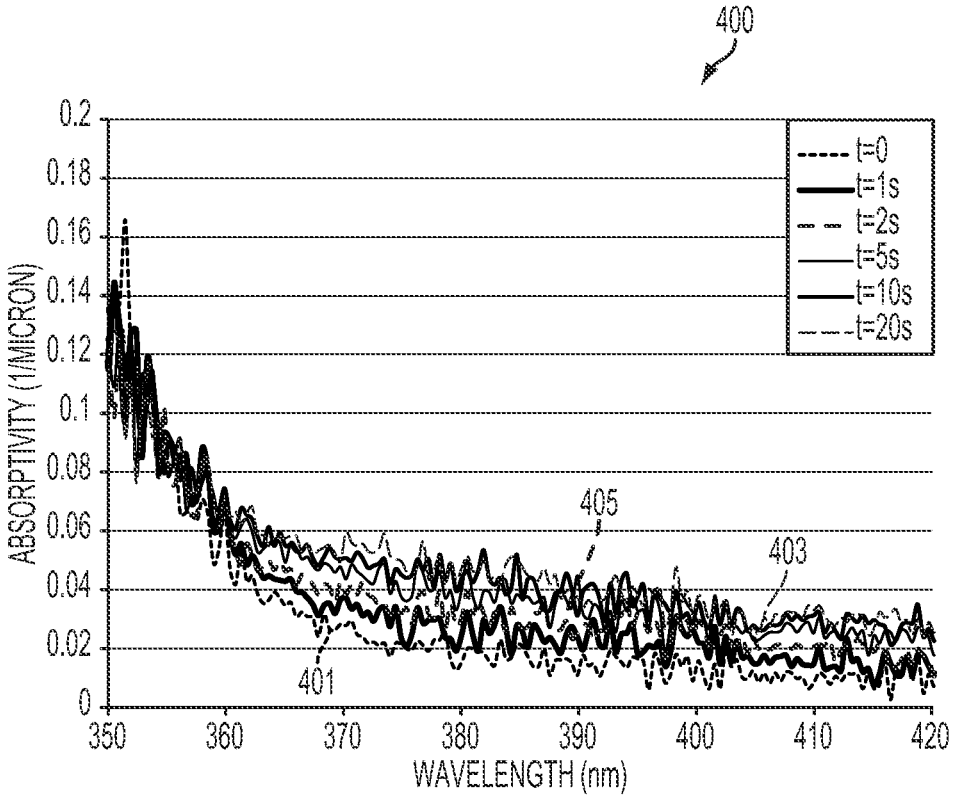
FIG. 4 is a chart illustrating the relationship between curing time and spectral absorptivity, according to one embodiment.

FIG. 4 is a chart 400 illustrating measured absorptivity data for an example measured image 115, discussed above, at different stages of curing as a function of time. In this example, an uncured image 109 of clear ink having a thickness of 6 microns is cured for various cure times (between 0 to 20 s), and absorptivity is measured at various wavelengths. At t=0, the image is the completely uncured and is the uncured image 109, discussed above. At t=20, in this example, the image is 100% cured. In this example, the printing system 100, for instance either had absorptivity data for an uncured image 109, or measured the uncured image 109 by way of the UV reflectance device 105, discussed above.

Similar to FIG. 3 discussed above, a spectral shift is determinable between the uncured line 401 and the cured line 403, as is a spectral shift between any of the intermediate lines 405 for any curing time between t=0 and t=20 s. The noticeable spectral shift that occurs for any of the intermediate lines 405 indicates that for curing times between t=0 and t=20 s, the measured image 115 is partially cured to an ascertainable degree based on the measured absorptivity data collected by the UV reflectance device 105.

Figure 5:
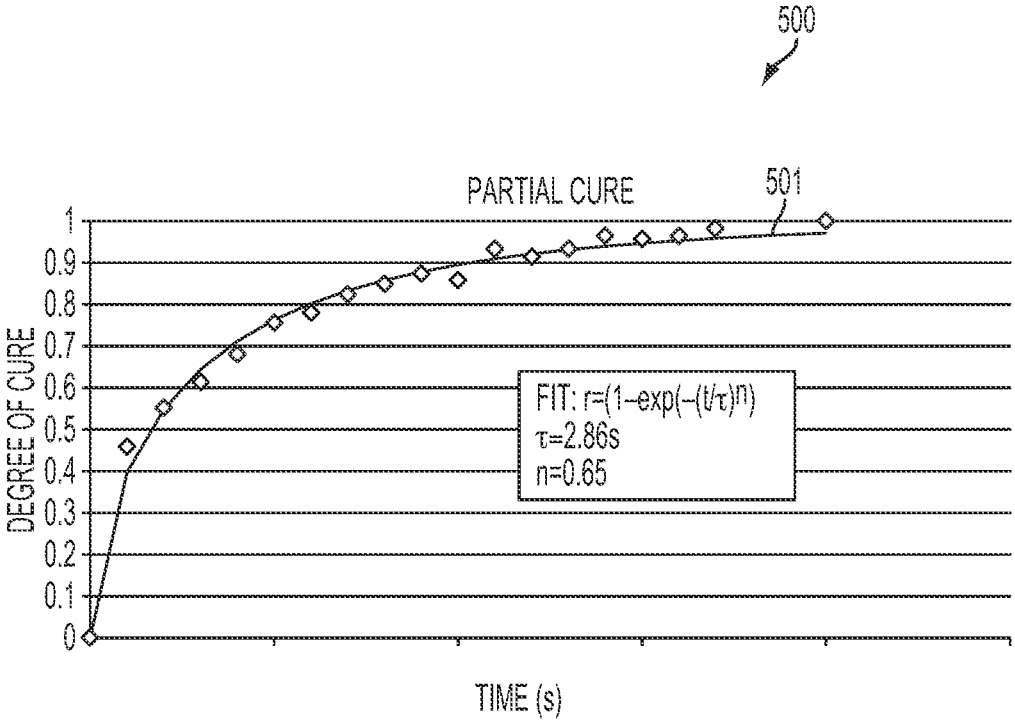
FIG. 5 is a chart illustrating the relationship between a degree of cure and curing time, according to one embodiment.

FIG. 5 is a chart illustrating an example plot 501 of the relationship between degree of cure and exposure/curing time. For example, based on Eq. (2) discussed above, the printing/cure control platform 107 may determine the curing time required to cause a subsequent uncured image 109 to be cured to a desired degree of cure between 0 and 100%. For example, the printing/cure control platform 107 may set the target degree of cure as 75% for a subsequent image, and cause the subsequent image to be exposed to UV light produced by the UV curing station 103 for 5 seconds. The degree of cure, as discussed above, is a function of many curing attributes. The printing system 100, in this example, may be configurable to change the exposure time to accomplish a target degree of cure. But, if the exposure time is fixed, then the printing/cure control platform 107 may accordingly adjust the intensity of the UV light source 104 such that the total number of photons to which the image is exposed is adjusted.

The plot 501 is merely exemplary, and may take any form based on whatever absorptivity data the UV reflectance device 105 provides based on its measurement of the measured image 115, discussed above. The plot 501 is also an example of how the printing/cure control platform 107 may apply determined absorptivity data and any determined reflectance values to ascertain a necessary exposure time to achieve a target degree of cure.

The processes described herein for determining a degree of cure of one or more ultraviolet sensitive inks having been cured as part of a printing process may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 6 illustrates a chip set or chip 600 upon which an embodiment may be implemented. Chip set 600 is programmed to determining a degree of cure of one or more ultraviolet sensitive inks having been cured as part of a printing process as described herein may include, for example, bus 601, processor 603, memory 605, DSP 607 and ASIC 609 components.

The processor 603 and memory 605 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 600 can be implemented in a single chip. It is further contemplated that in certain embodiments the chip set or chip 600 can be implemented as a single "system on a chip." It is further contemplated that in certain embodiments a separate ASIC would not be used, for example, and that all relevant functions as disclosed herein would be performed by a processor or processors. Chip set or chip 600, or a portion thereof, constitutes a means for performing one or more steps of determining a degree of cure of one or more ultraviolet sensitive inks having been cured as part of a printing process.

In one or more embodiments, the chip set or chip 600 includes a communication mechanism such as bus 601 for passing information among the components of the chip set 600. Processor 603 has connectivity to the bus 601 to execute instructions and process information stored in, for example, a memory 605. The processor 603 may include one or more processing cores with each core configured to perform independently. A multi-core processor enables multiprocessing within a single physical package. Examples of a multi-core processor include two, four, eight, or greater numbers of processing cores. Alternatively or in addition, the processor 603 may include one or more microprocessors configured in tandem via the bus 601 to enable independent execution of instructions, pipelining, and multithreading. The processor 603 may also be accompanied with one or more specialized components to perform certain processing functions and tasks such as one or more digital signal processors (DSP) 607, or one or more application-specific integrated circuits (ASIC) 609. A DSP 607 typically is configured to process real-world signals (e.g., sound) in real time independently of the processor 603. Similarly, an ASIC 609 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 603 performs a set of operations on information as specified by computer program code related to determining a degree of cure of one or more ultraviolet sensitive inks having been cured as part of a printing process. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 601 and placing information on the bus 601. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 603, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 603 and accompanying components have connectivity to the memory 605 via the bus 601. The memory 605 may include one or more of dynamic memory (e.g., RAM, magnetic disk, writable optical disk, etc.) and static memory (e.g., ROM, CD-ROM, etc.) for storing executable instructions that when executed perform the inventive steps described herein to determining a degree of cure of one or more ultraviolet sensitive inks having been cured as part of a printing process. The memory 605 also stores the data associated with or generated by the execution of the inventive steps.

In one or more embodiments, the memory 605, such as a random access memory (RAM) or any other dynamic storage device, stores information including processor instructions for determining a degree of cure of one or more ultraviolet sensitive inks having been cured as part of a printing process. Dynamic memory allows information stored therein to be changed by system 100. RAM allows a unit of information stored at a location called a memory address to be stored and retrieved independently of information at neighboring addresses. The memory 605 is also used by the processor 603 to store temporary values during execution of processor instructions. The memory 605 may also be a read only memory (ROM) or any other static storage device coupled to the bus 601 for storing static information, including instructions, that is not changed by the printing system 100. Some memory is composed of volatile storage that loses the information stored thereon when power is lost. The memory 605 may also be a non-volatile (persistent) storage device, such as a magnetic disk, optical disk or flash card, for storing information, including instructions, that persists even when the printing system 100 is turned off or otherwise loses power.

The term "computer-readable medium" as used herein refers to any medium that participates in providing information to processor 603, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method comprising:

determining an absorptivity spectra value for one or more ultraviolet inks at a time before curing;

causing, at least in part, the one or more ultraviolet inks to be applied to a substrate to form an image;

causing, at least in part, the image to be exposed to ultraviolet (UV) light produced by one or more ultraviolet light sources to cause, at least in part, the one or more ultraviolet inks to be cured to form a cured image;

determining an absorptivity spectra value of the cured image;

causing, at least in part, the absorptivity value of the one or more ultraviolet inks before curing to be compared to the absorptivity spectra value of the cured image to determine an absorptivity spectral shift;

determining a reflectance value of the cured image, wherein the reflectance value is based, at least in part, on the absorptivity spectral shift;

determining a degree of cure of the cured image based, at least in part, on the reflectance value; and controlling the degree of cure of any subsequent image formed on the substrate by a printing system by causing the one or more ultraviolet light sources to vary one or more wavelength of the UV light, intensity of the UV light, or causing the printing system to vary the exposure time to which the uncured image is exposed to the UV light produced by the one or more ultraviolet light sources to form the cured image.

2. A method of claim 1, further comprising:

causing, at least in part, the cured image to be exposed to ultraviolet light produced by one or more other ultraviolet light sources at a time after curing, wherein the reflectance value is determined based, at least in part, on data collected by a sensor positioned on a side of the substrate having the image.

3. A method of claim 1, further comprising:

causing, at least in part, the cured image to be exposed to ultraviolet light produced by one or more other ultraviolet light sources at a time after curing, wherein the reflectance value is determined based, at least in part, on data collected by a sensor positioned on a side of the substrate opposite a side of the substrate having the image, the reflectance value being based, at least in part, on a determined amount of ultraviolet light that is transmitted through the cured image and the substrate.

4. A method of claim 1, further comprising:

determining a target degree of cure different from the determined degree of cure;

causing, at least in part, a degree of cure of another image formed at another printing system in a networked printing system to be the target degree of cure based, at least in part, on a variance of one or more curing process attributes that are associated with the determined degree of cure.

5. A method of claim 4, wherein the one or more curing process attributes comprise an intensity of the one or more ultraviolet light sources, the method further comprising:

determining the intensity of the one or more ultraviolet light sources associated with the determined degree of cure; and causing, at least in part, the degree of cure of the another image to be the target degree of cure by changing the intensity.

6. A method of claim 4, wherein the one or more curing process attributes comprise an exposure time of the image to the ultraviolet light, the method further comprising:

determining the exposure time associated with the determined degree of cure; and causing, at least in part, the degree of cure of the another image to be the target degree of cure by changing the exposure time.

7. A method of claim 4, wherein the one or more curing process attributes comprise a spectrum of the ultraviolet light produced by the one or more ultraviolet light sources, the method further comprising:

determining the spectrum associated with the determined degree of cure; and causing, at least in part, the degree of cure of the another image to be the target degree of cure by changing the spectrum of the ultraviolet light produced by the one or more ultraviolet light sources.

8. A method of claim 4, wherein the degree of cure is determined in real time and the target degree of cure is caused on demand.

9. A method of claim 4, wherein the networked printing system comprises two or more printing systems, the two or more printing systems each being configured to form a respective copy of the image, the method further comprising:

determining the degree of cure of each of the images formed by each of the two or more printing systems;

determining the target degree of cure of at least one of the two or more printing systems is different from the determined degree of cure;

causing, at least in part, a degree of cure of another image printed by at least one of the two or more printing systems to be the target degree of cure based, at least in part, on a variance of one or more curing process attributes that are associated with the determined degree of cure at the at least one of the two or more printing systems, wherein each of the two or more printing systems is configured to be individually calibrated to cause a uniform degree of cure among all of the two or more printing systems.

10. A method of claim 1, wherein the degree of cure is determined inline with the application of the one or more ultraviolet inks to the substrate.

11. An apparatus comprising:

at least one processor; and at least one memory including computer program code for one or more programs, the at least one memory and the computer program code configured to, with the at least one processor, cause the apparatus to perform at least the following:

cause to determine an absorptivity spectra value for one or more ultraviolet (UV) inks at a time before curing;

cause, at least in part, the one or more ultraviolet (UV) inks to be applied to a substrate to form an image;

cause, at least in part, the image be exposed to ultraviolet (UV) light produced by one or more ultraviolet light sources to cause, at least in part, the one or more ultraviolet inks to be cured to form a cured image;

cause to determine an absorptivity spectra value of the cured image;

cause, at least in part, the absorptivity value of the one or more ultraviolet inks before curing to be compared to the absorptivity spectra value of the cured image to determine an absorptivity spectral shift;

determine a reflectance value of the cured image, wherein the reflectance value is based, at least in part, on the absorptivity spectral shift;

determine a degree of cure of the cured image based, at least in part, on the reflectance value; and cause to control the degree of cure of any subsequent image formed on the substrate by a printing system by causing the one or more ultraviolet light sources to vary one or more wavelength of the UV light, intensity of the UV light, or causing the printing system to vary the exposure time to which the uncured image is exposed to the UV light produced by the one or more ultraviolet light sources to form the cured image.

12. An apparatus of claim 11, wherein the apparatus is further caused to:

cause, at least in part, the cured image to be exposed to ultraviolet light produced by one or more other ultraviolet light sources at a time after curing, wherein the reflectance value is determined based, at least in part, on data collected by a sensor positioned on a side of the substrate having the image.

13. An apparatus of claim 11, wherein the apparatus is further caused to:

cause, at least in part, the cured image to be exposed to ultraviolet light produced by one or more other ultraviolet light sources at a time after curing, wherein the reflectance value is determined based, at least in part, on data collected by a sensor positioned on a side of the substrate opposite a side of the substrate having the image, the reflectance value being based, at least in part, on a determined amount of ultraviolet light that is transmitted through the cured image and the substrate.

14. An apparatus of claim 11, wherein the apparatus is further caused to:

determine a target degree of cure different from the determined degree of cure;

cause, at least in part, a degree of cure of another image to be the target degree of cure based, at least in part, on a variance of one or more curing process attributes that are associated with the determined degree of cure.

15. An apparatus of claim 14, wherein the one or more curing process attributes comprise an intensity of the one or more ultraviolet light sources, and the apparatus is further caused to:

determine the intensity of the one or more ultraviolet light sources associated with the determined degree of cure; and cause, at least in part, the degree of cure of the another image to be the target degree of cure by changing the intensity.

16. An apparatus of claim 14, wherein the one or more curing process attributes comprise an exposure time of the image to the ultraviolet light, the method further comprising:

determine the exposure time associated with the determined degree of cure; and cause, at least in part, the degree of cure of the another image to be the target degree of cure by changing the exposure time.

17. An apparatus of claim 14, wherein the one or more curing process attributes comprise a spectrum of the ultraviolet light produced by the one or more ultraviolet light sources, and the apparatus is further caused to:

determine the spectrum associated with the determined degree of cure; and cause, at least in part, the degree of cure of the another image to be the target degree of cure by changing the spectrum of the ultraviolet light produced by the one or more ultraviolet light sources.

18. An apparatus of claim 14, wherein the degree of cure is determined in real time and the target degree of cure is caused on demand.

19. An apparatus of claim 14, wherein a system comprises two or more printing systems, the two or more printing systems each being configured to form a respective copy of the image, and the apparatus is further caused to:

determine the degree of cure of each of the images formed by each of the two or more printing systems;

determine the target degree of cure of at least one of the two or more printing systems is different from the determined degree of cure;

cause, at least in part, a degree of cure of another image printed by at least one of the two or more printing systems to be the target degree of cure based, at least in part, on a variance of one or more curing process attributes that are associated with the determined degree of cure at the at least one of the two or more printing systems, wherein each of the two or more printing systems is configured to be individually calibrated to cause a uniform degree of cure among all of the two or more printing systems.

20. An apparatus of claim 11, wherein the degree of cure is determined inline with the application of the one or more ultraviolet inks to the substrate.

* * * * *